US007882632B2

(12) United States Patent
Yoshida et al.

(10) Patent No.: US 7,882,632 B2
(45) Date of Patent: Feb. 8, 2011

(54) INDUSTRIAL PUMP AND MANUFACTURING METHOD THEREOF

(75) Inventors: Tetsuya Yoshida, Tsuchiura (JP); Yoshimasa Chiba, Tsukuba (JP)

(73) Assignee: Hitachi Industries Co., Ltd., Tokyo (JP)

( * ) Notice: Subject to any disclaimer, the term of this patent is extended or adjusted under 35 U.S.C. 154(b) by 790 days.

(21) Appl. No.: 11/342,692

(22) Filed: Jan. 31, 2006

(65) Prior Publication Data

US 2006/0204386 A1 Sep. 14, 2006

(30) Foreign Application Priority Data

Feb. 1, 2005 (JP) ..... 2005-025289

(51) Int. Cl.
*B23P 11/02* (2006.01)
*F04D 29/10* (2006.01)

(52) U.S. Cl. ..... 29/888.024; 29/447; 415/180; 415/230

(58) Field of Classification Search ..... 415/109, 415/110, 111, 178, 180, 229, 230; 29/447, 29/888.024, 888.02
See application file for complete search history.

(56) References Cited

U.S. PATENT DOCUMENTS 1,837,873 A * 12/1931 MacMeeken ..... 415/105
1,909,410 A * 5/1933 Klosson ..... 415/180
3,133,344 A * 5/1964 Keasler ..... 29/898.01
3,386,648 A * 6/1968 Van Rossem ..... 418/108
3,600,101 A * 8/1971 Oglesby et al. ..... 415/111
4,750,457 A * 6/1988 Bonutti ..... 123/198 D

FOREIGN PATENT DOCUMENTS

| | | |
|---|---|---|
| JP | 07-305691 | 11/1995 |
| JP | 10-176627 | 6/1998 |
| JP | 2001-218425 | 8/2001 |
| JP | 2001-333559 | 11/2001 |

* cited by examiner

*Primary Examiner*—Nathaniel Wiehe
(74) *Attorney, Agent, or Firm*—Antonelli, Terry, Stout & Kraus, LLP.

(57) ABSTRACT

In an industrial pump, a bearing provided in a pump main body rotatably supports both end sides of a rotating shaft to which an impeller is attached. A shaft seal apparatus is arranged in adjacent to the bearing. The shaft seal apparatus is cooled by a cooling water introduced from an external portion. A shaft seal case is fitted to an inner peripheral surface of a bracket accommodating the shaft seal apparatus in accordance with a shrink fitting. A cooling water is circulated in a boundary portion between the bracket and the shaft seal case. It is omitted a work for closing an opening portion of a cooling means for circulating the cooling water by welding.

5 Claims, 6 Drawing Sheets

INDUSTRIAL PUMP AND MANUFACTURING METHOD THEREOF

The present application claims priority from Japanese application JP2005-25289 filed on Feb 1, 2005, the content of which is hereby incorporated by reference into this application.

BACKGROUND OF THE INVENTION

The present invention relates to an industrial pump supplying water mainly a high-temperature water, such as a feed water pump used in a heat power plant, an atomic power plant and the like.

Conventionally, a mechanical seal or the like is used in a shaft seal apparatus for an industrial pump supplying the water, mainly the high-temperature water, such as a boiler feed water pump used in the heat power plant and an atomic reactor feed water pump used in the atomic power plant. Since the shaft seal apparatus reaches a high temperature at a time of operating the pump, the shaft seal apparatus prevents a reduction of a shaft seal performance by being cooled by a cooling water introduced from an outside of the pump.

Further, as a cooling method of the shaft seal apparatus, for example, as described in JP-A-7-305691, there is employed a method of cooling the shaft seal apparatus by forming a jacket chamber in a part of a casing and a part of a mechanical seal cover, or between the casing and the mechanical seal cover so as to surround the shaft seal apparatus, and injecting the cooling water into the jacket chamber from the outside of the pump.

On the other hand, as a method of forming the jacket chamber so as to surround the shaft seal apparatus, as described in JP-A-7-305691, there is a method, for example, shown in FIGS. 7 and 8, in addition to a method of closing an opening portion of the jacket chamber formed within the casing by the mechanical seal cover, a method of closing the jacket chamber formed within the mechanical seal cover by the casing, a method of forming the jacket chamber in a juncture portion between the casing and the mechanical seal cover, and the like.

In a structure of a cooling means shown in FIG. 7, a cooling chamber c is formed within a bracket b so as to surround a shaft seal apparatus a, and a cover d is firmly fixed to an opening portion of the cooling chamber c in a liquid tight manner by a means such as a welding or the like.

Further, in a structure of a cooling means shown in FIG. 8, a cooling chamber c is formed in a shaft seal case e of a shaft seal apparatus a, a bracket b provided around the shaft seal case e closes an opening portion of the cooling chamber c, and a packing, for example, an O-ring f or the like is interposed in a boundary surface between the shaft seal case e and the bracket b, for preventing a liquid leak.

However, as in a fluid machine described in JP-A-7-305691, in a structure in which the jacket chamber is formed in a part of the casing or the mechanical seal cover, and the cooling chamber c is formed within the bracket b as shown in FIG. 7, since a structure of a wooden mold for manufacturing a casting mold becomes complicated in the case of manufacturing the casing, the mechanical seal cover and the bracket b as a cast product, a cost of the wooden mold becomes expensive. Further, it is necessary to previously form an opening for getting out sand in the jacket chamber and the cooling chamber in the cast product using the casting mold.

Accordingly, it is necessary to close the opening portion of the jacket chamber by a part of the mechanical seal cover and the casing after casting (in the case of JP-A-7-305691), or seal the opening portion of the cooling chamber c by the cover d (in the case of the cooling means shown in FIG. 7). As a result, the structure of the cooling means becomes complicated, and a cost of an entire pump is increased.

Further, since a defect such as a blow hole or the like tends to be generated in the casting at a time of casting, the casting lacks of a reliability. Further, in the case that the cover d is welded to the opening portion of the cooling chamber c, it is necessary to execute a work of forming a concave step portion in the opening portion of the cooling chamber c in accordance with a machine work, welding the cover d in a state of fitting the cover d to the concave step portion, and thereafter applying a heat treatment for removing a residual stress of the weld portion. Accordingly, a lot of work man hour is necessary for the machine work and the weld work, and a cost of an entire pump is increased.

On the other hand, as shown in JP-A-7-305691 and FIG. 8, in the structure in which the cooling chamber c is formed in the boundary portion between the casing and the mechanical seal cover or the boundary portion between the shaft seal case e and the bracket b, the O-ring f is provided for preventing the liquid leak from the boundary surface, however, since the O-ring f is deteriorated by the use under the high temperature and the seal effect is lowered at an early stage, it is necessary to periodically replace the O-ring.

However, it is necessary to execute the replacing work of the O-ring f by dissembling the shaft seal apparatus a, a lot of time and man hour are required for the replacing work and a workability is bad. Further, since the pump can not be operated during a repair period, it is necessary to stop the plant.

BRIEF SUMMARY OF THE INVENTION

The present invention is made for improving the problem of the prior arts mentioned above, and an object of the present invention is to provide an industrial pump in which a cooling means for cooling a shaft seal apparatus is easily formed, and a manufacturing method thereof.

In accordance with the present invention, there is provided an industrial pump comprising:

a pump main body;

a rotating shaft accommodated within the pump main body and to which an impeller is attached;

a bearing rotatably supporting both end sides of the rotating shaft; and a shaft seal apparatus arranged in adjacent to the bearing, wherein a bracket is provided in the pump main body, and a shaft seal case provided in the shaft seal apparatus is fitted to the bracket in accordance with a shrink fitting so as to be integrated. At least one of the bracket and the shaft seal case cools the shaft seal apparatus by circulating a cooling water introduced from an external portion in a boundary portion between the bracket and the shaft seal case.

In accordance with the structure, it is possible to use a cast product in which it is not necessary to manufacture a casting mold by using a wooden mold having a complicated structure, and a cost of the wooden mold is not required. Accordingly, it is possible to shorten a manufacturing period, it is not necessary to weld the cover to the opening portion of the cooling chamber so as to close, the welding work and the heat treatment after the welding are not required, and it is possible to intend to reduce a working man hour required for the works. Further, it is possible to reduce a cost of an entire pump.

In the industrial pump in accordance with the present invention, an annular cooling chamber is provided in an inner peripheral surface of the bracket, or an annular cooling water flow path is provided in an outer peripheral surface of the shaft seal case. In accordance with the structure mentioned above, it is possible to directly cool the outer peripheral surface of the shaft seal case by using the cooling water introduced to the cooling chamber of the cooling water flow path from the external portion, and a cooling effect of the shaft seal apparatus is further improved. In addition, it is possible to easily form the cooling chamber or the cooling water flow path in the bracket or the shaft seal case. A reduction of a parts cost can be achieved.

In the industrial pump in accordance with the present invention, a concavo-convex surface constituted by an annular concave groove and an annular protrusion is formed in a fitting surface between the bracket and the shaft seal case. In accordance with the structure, an average surface pressure becomes twice as much as the case that the fitting surface between the bracket and the shaft seal case is formed as a flat surface. It is not necessary that the O-ring for preventing the liquid leak is provided in the boundary of the fitting surface between the bracket and the shaft seal case. Accordingly, it is not necessary to execute a maintenance work of dissembling the shaft seal apparatus and periodically replacing the O-ring, or the like. It is possible to solve the problem that the pump can not be operated during the repair period and it is necessary to stop the plant.

In the industrial pump in accordance with the present invention, a leading end side corner portion of the protrusion is formed in an edge shape, and a curvature R is formed in a portion corresponding to a portion of the bracket to which a stress tends to be concentrated at a time of shrink fitting, and brought into contact with an end portion of the shaft seal case. In accordance with the structure, when shrink fitting the shaft seal case to the bracket, one fitting surface bites into an opposing member, and a surface pressure of the edge portion in the protrusion can obtain a high surface pressure which is locally severalfold as much as the average surface pressure. In addition, it is possible to adjust a rate between the concave groove and the protrusion in an entire length of the fitting portion, and an optional surface pressure can be obtained between both the elements. Further, it is possible to disperse a concentrated stress at a time of the shrink fitting, and a durability of the bracket and the shaft seal case is improved.

In accordance with the present invention, both end sides of the rotating shaft to which the impeller is attached are rotatably supported by a bearing installed in the pump main body. The shaft seal apparatus arranged in adjacent to the bearing is cooled by the cooling water introduced from the external portion. The cooling chamber or the cooling water flow path is formed in the inner peripheral surface of the bracket to which the shaft seal apparatus is attached, or the outer peripheral surface of the shaft seal case. The concavo-convex surface constituted by the annular concave groove and the annular protrusion is formed in the fitting surface of the bracket or the shaft seal case. In addition, the shaft seal case is fitted to the inner periphery of the bracket in a state of heating the bracket and cooling the shaft seal case. Thereafter, the bracket and the shaft seal case are cooled, and the shaft seal case is shrink fitted into the bracket.

In accordance with this method, it is possible to use the cast product, and it is not necessary to manufacture the casting mold by using the wooden mold having the complicated structure. Further, it is possible to shorten a manufacturing period. Further, it is not necessary to weld the cover to the opening portion of the cooling chamber so as to close, and the welding work and the heat treatment after the weld are not necessary. Further, it is possible to reduce the working man hour required for the works, and it is possible to reduce a cost of an entire pump. Since the average surface pressure becomes twice as much as the case that the fitting surface between the bracket and the shaft seal case is formed as the flat surface, and it is not necessary that the O-ring for preventing the liquid leak is provided in the boundary of the fitting surface between the bracket and the shaft seal case. It is not necessary to execute a maintenance work of dissembling the shaft seal apparatus and periodically replacing the O-ring, or the like. It is possible to solve the problem that the pump can not be operated during the repair period and it is necessary to stop the plant.

Other objects, features and advantages of the invention will become apparent from the following description of the embodiments of the invention taken in conjunction with the accompanying drawings.

DETAILED DESCRIPTION OF THE INVENTION

Figure 1:
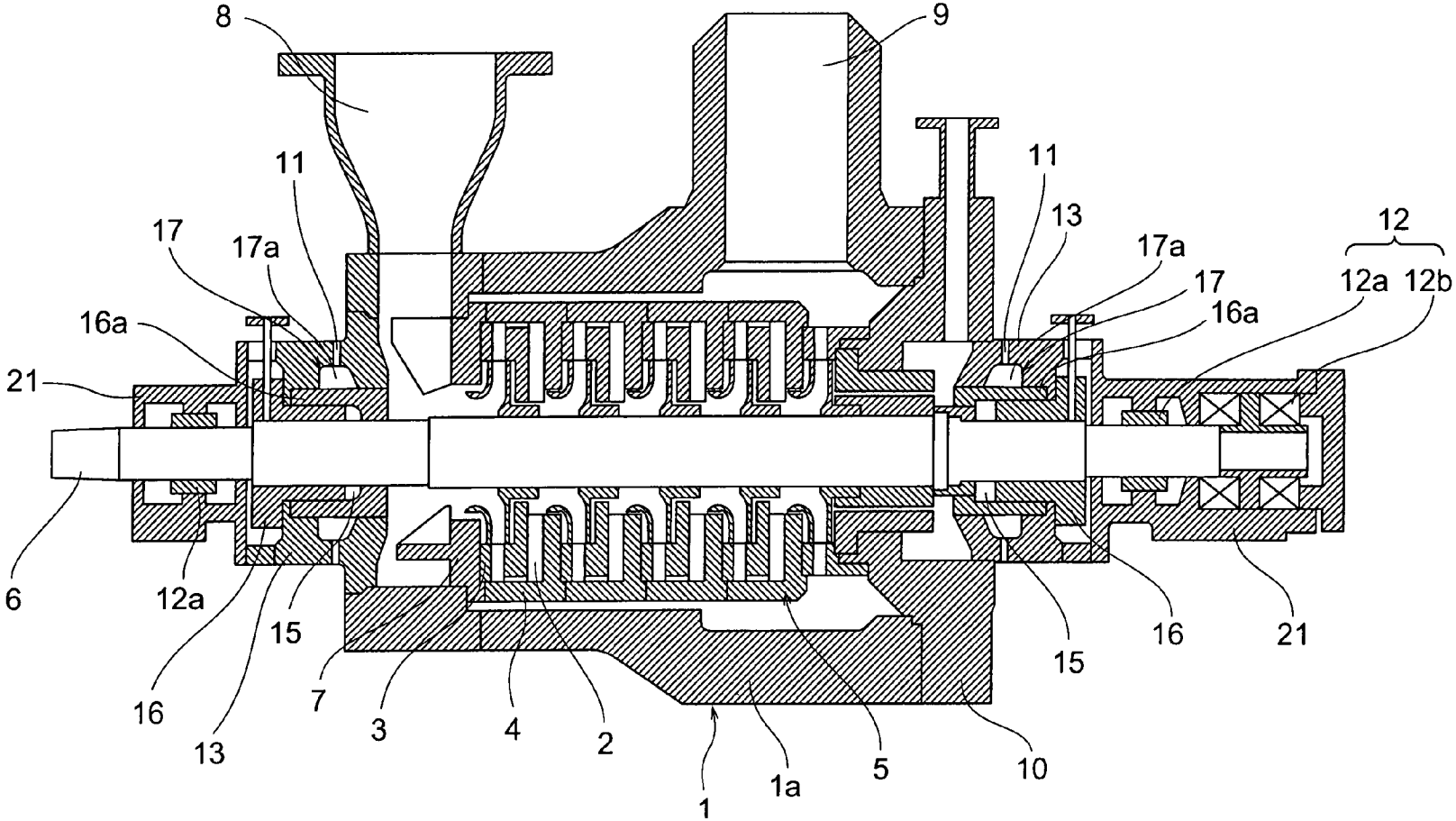
FIG. 1 is a vertical cross sectional view of an embodiment of an industrial pump in accordance with the present invention.
Figure 2:
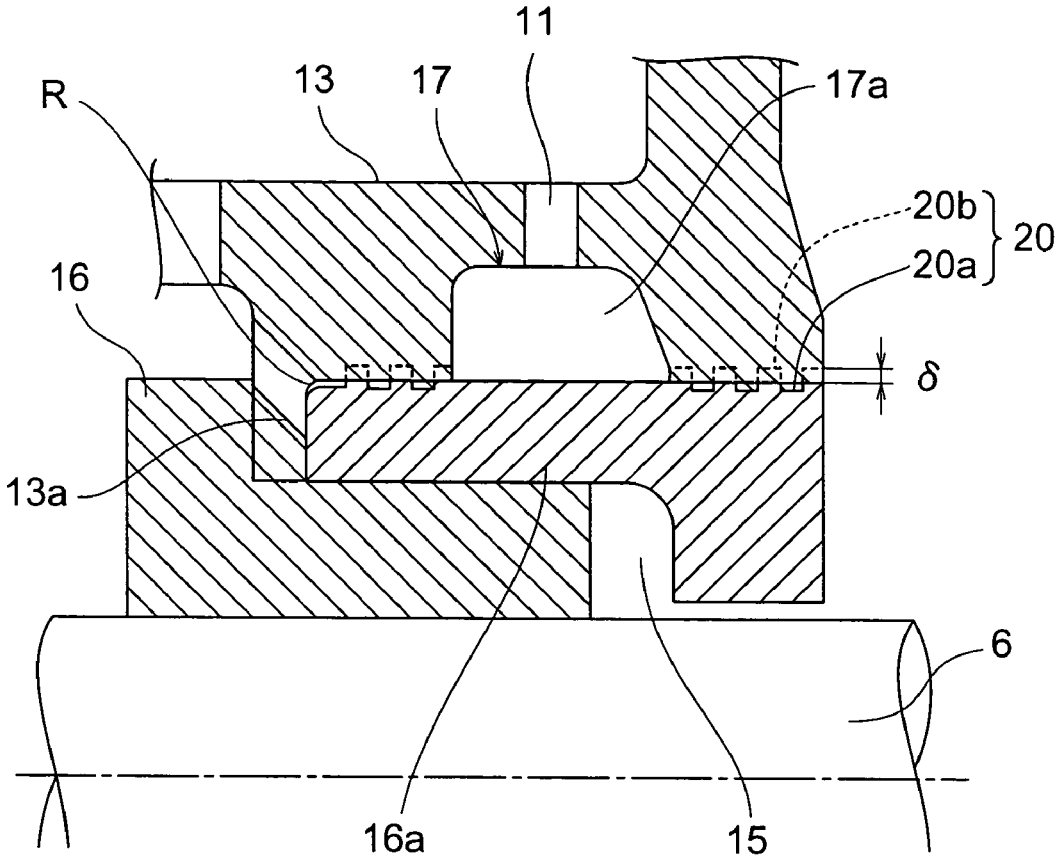
FIG. 2 is a vertical cross sectional view of details near a shaft seal apparatus.
Figure 3:
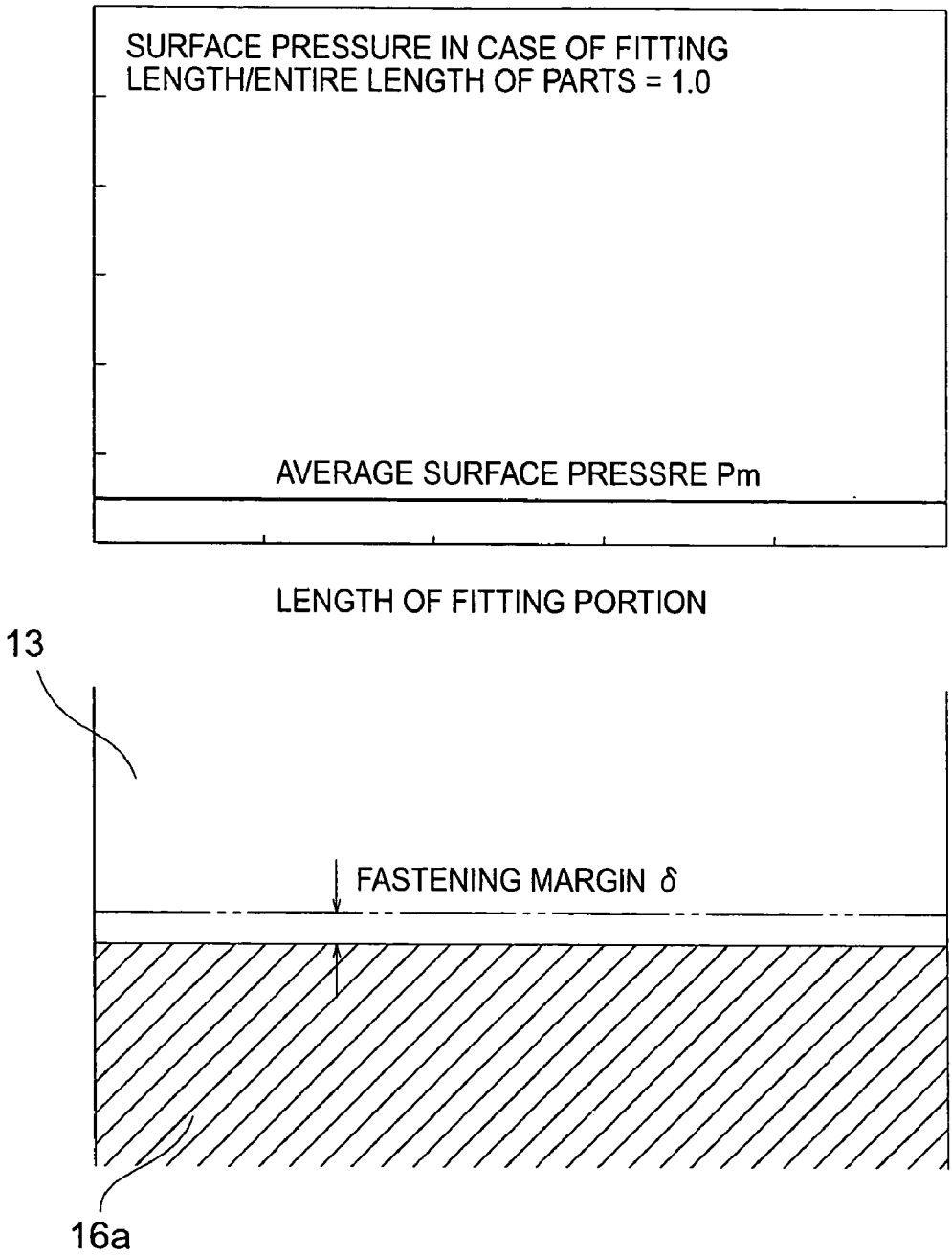
FIG. 3 is a view explaining a shrink fitting of a shaft seal case.
Figure 4:
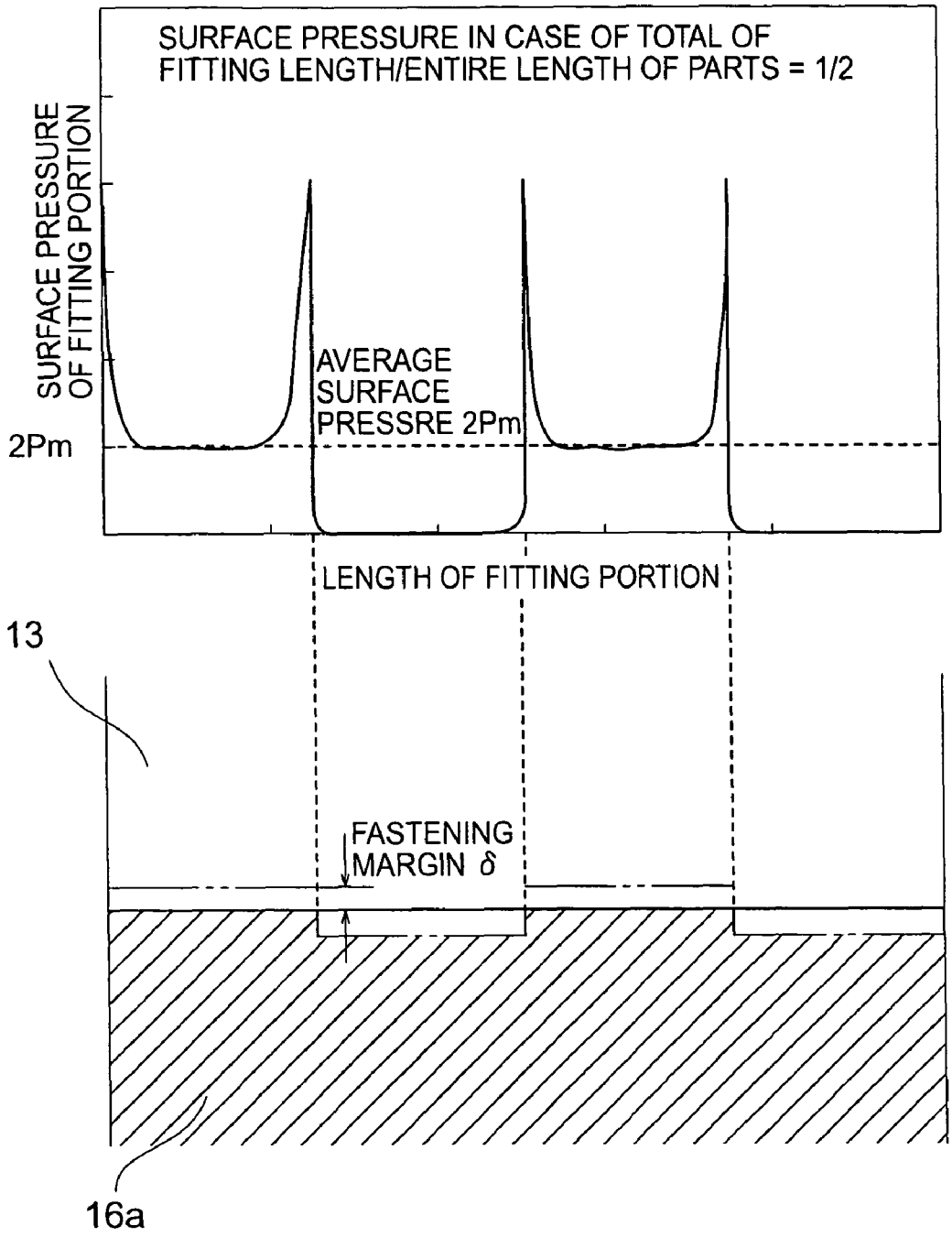
FIG. 4 is a view explaining a shrink fitting of a shaft seal case.

A description will be given in detail of an embodiment in accordance with the present invention with reference to the accompanying drawings. FIG. 1 is a vertical cross sectional view of a barrel type multi-stage turbine pump corresponding to an embodiment of an industrial pump, and FIG. 2 is a vertical cross sectional view of details near a shaft seal apparatus of the turbine pump shown in FIG. 1. FIGS. 3 and 4 are views explaining a shrink fitting of a shaft seal case of the industrial pump.

In a pump main body 1 of the turbine pump shown in FIG. 1, an inner casing 5 having a plurality of stages provided with a return guide vane 2 and a guide vane 3, both having a rectifying action, is provided within an outer casing 1*a* called as a barrel casing. Centers of the outer casing 1*a* and the inner casing 5 are identical, and a rotating shaft 6 is provided so as to pass through a center portion of the inner casing 5. An impeller 7 provided in each of the stages 4 is attached to the rotating shaft 6.

A suction port 8 is provided in an outer peripheral portion in one end side of the outer casing 1*a*. A high-temperature water is flowed into the first stage impeller 7 of the inner casing 5 from the suction port 8. The high-temperature water flowed into the first stage impeller 7 is sequentially boosted by the plural stages of impellers 7 provided in every stages 4 and reaches the final stage impeller 7. Further, the high-temperature water is discharged from a discharge port 9 provided in an outer peripheral portion in the other end side of the outer casing 1*a*.

A casing cover 10 having a structure standing against a high-pressure water is fastened to an opening portion in the discharge port 9 side of the outer casing 1*a* by a fastening device such as a bolt or the like (not shown). A bearing housing 21 in which a bearing 12 rotatably supporting the rotating shaft 6 is accommodated is fastened to one end side of the outer casing 1*a* and a center portion of the casing cover 10 by a fastening device (not shown) via a bracket 13.

A radial bearing 12*a* is accommodated within the bearing housing 21 fastened to one end side of the outer casing 1*a*, and a radial bearing 12*a* and a thrust bearing 12*b* are accommodated within the bearing housing 21 fastened to the casing cover 10 side. Each of the radial bearings 12*a* supports a load in a radial direction of the rotating shaft 6, and the thrust bearing 12*b* supports a load in a thrust direction.

A shaft seal chamber 15 is formed within each of the brackets 13, between the bearing housing 21 and the suction port 8 and between the casing cover 10 and the bearing housing 21. A shaft seal apparatus 16 such as a mechanical seal or the like is accommodated within the shaft seal chamber 15. A cooling means 17 is provided around the shaft seal chamber 15. The cooling means 17 cools the shaft seal apparatus 16 by a cooling water introduced from an outside of the pump via a water filler 11. The cooling water cooling the shaft seal apparatus 16 is discharged to the outside of the pump from a water outlet (not shown).

The cooling means 17 has an annular cooling chamber 17*a* formed in an inner peripheral surface of the bracket 13 as shown in FIG. 2. A shaft seal case 16*a* of the shaft seal apparatus 16 is shrink fitted to the inner peripheral surface of the bracket 13 in accordance with a method mentioned below. An opening portion of the cooling chamber 17*a* is sealed by the shaft seal case 16*a*. In addition, the bracket 13 and the shaft seal case 16*a* are integrally formed. A radius R is formed in a corner portion in the shaft seal case 16*a* side of a flange 13*a* protruded from the inner peripheral surface of the bracket 13 so as to prevent a stress from being concentrated to a root portion of the flange 13*a* after the shrink fitting.

It is necessary to pay attention to the following points, at a time of shrink fitting the shaft seal case 16*a* to the inner peripheral surface of the bracket 13 so as to form a cooling chamber 17*a* having a sealed structure. A predetermined fastening margin 8 is formed in a fitting portion between both the elements 13 and 16*a* after manufacturing the bracket 13 and the shaft seal case 16*a*. Accordingly, both the elements 13 and 16*a* are machined in such a manner that an inner diameter of the bracket 13 becomes smaller at a degree of the fastening margin δ, or an outer diameter of the shaft seal case 16*a* becomes larger at a degree of the fastening margin δ. Thereafter, the bracket 13 and the shaft seal case 16*a* are shrink fitted. At this time, if a fitting surface 20 between the bracket 13 and the shaft seal case 16*a* is formed in a flat surface over an entire length of the fitting portion as shown in FIG. 3, a surface pressure Pm of the fitting portion obtained by the fastening margin δ becomes approximately uniform in a longitudinal direction of the fitting portion.

On the contrary, in the case of forming a concavo-convex portion corresponding to the fastening margin δ in one of the fitting surfaces 20 in a circumferential direction so as to shrink fit, as shown in FIG. 4, a surface pressure of the fitting portion is increased in comparison with the case of FIG. 3 in which the fitting surface 20 is formed in the flat surface. In the case of FIG. 4, the concavo-convex portion is formed with respect to an entire length of the fitting portion in such a manner that a rate of the concave groove 20*a* and the protrusion 20*b* satisfies a relation 1:1. As is apparent from FIG. 4, if the concavo-convex portion is formed in the fitting surface 20, the average surface pressure becomes 2 Pm which is approximately twice as much as the case that the fitting surface 20 is formed in the flat surface.

Since the corner portion of the protrusion 20*b* is not rounded but is formed in a sharp edge shape, one fitting surface 20 is plastically deformed and the protrusion 20*b* bites into the opposing member, at a time of shrink fitting the bracket 13 and the shaft seal case 16*a*. A surface pressure of the edge portion of the protrusion 20*b* becomes locally a high surface pressure which is about threefold to fourfold as much as the average surface pressure Pm. In accordance with the present method, it is possible to adjust the surface pressure Pm between the bracket 13 and the shaft seal case 16*a* by appropriately selecting the rate between the concave groove 20*a* and the protrusion 20*b* over an entire length of the fitting portion. Accordingly, it is possible to freely adjust the surface pressure in correspondence to a specification, a magnitude, a used condition and the like of the industrial pump.

A description will be given of the method of shrink fitting the shaft seal case 16*a* of the shaft seal apparatus 16 to the inner peripheral surface of the bracket 13. When the cooling chamber 17 having the sealed structure is manufactured by shrink fitting the shaft seal case 16*a* to the inner peripheral surface of the bracket 13, the bracket 13 and the shaft seal case 16*a* are manufactured by using the same metal material. Because the portion near the shaft seal apparatus 16 comes to a high temperature at a time of being operated in the industrial pump used for feeding the high-temperature water, and in the case that the bracket 13 and the shaft seal case 16*a* are manufactured by the different metal materials, a non-uniformity of the surface pressure and a reduction of the surface pressure are generated in the fitting surface 20 due to the difference of a thermal expansion coefficient, and a water leak is caused.

The bracket 13 and the shaft seal case 16*a* are manufactured in accordance with a forging process by using the same metal material. When shrink fitting, the fitting surfaces 20 are precisely machined so that a predetermined fastening margin δ can be obtained. At this time, the concave groove 20*a* and the protrusion 20*b* are formed in one of the fitting surfaces 20. Next, the bracket 13 side is heated, for example, about 150° C. by a heating furnace or the like. An inner diameter of the bracket 13 is enlarged on the basis of a thermal expansion. On the other hand, the shaft seal case 16*a* side is cooled about −40° C. by a dry ice or the like, thereby heat contracting an outer diameter of the shaft seal case 16*a*.

In this state, the shaft seal case 16*a* is fitted and inserted to the inner peripheral surface of the bracket 13, and the cooling chamber 17*a* formed in the inner peripheral surface of the bracket 13 is sealed. Thereafter, the bracket 13 and the shaft seal case 16*a* are naturally cooled or forcedly cooled. After shrink fitting the outer peripheral surface of the shaft seal case 16*a* to the inner peripheral surface of the bracket 13, the bracket 13 is contracted on the basis of the natural cooling or the forced cooling, and the shaft seal case 16*a* is expanded. At this time, the protrusion 20*b* protruded from the fitting portion 20 bites into the fitting surface 20 of the opposing member, and the bracket 13 and the shaft seal case 16*a* are integrated. On the basis of this, a high surface pressure Pm shown in FIG. 4 is obtained in the fitting surface 20. Even if the O-ring for preventing the leak is not provided in the boundary surface between the bracket 13 and the shaft seal case 16*a*, the liquid leak is not generated. The seal means such as the O-ring or the like is not necessary.

Figure 5:
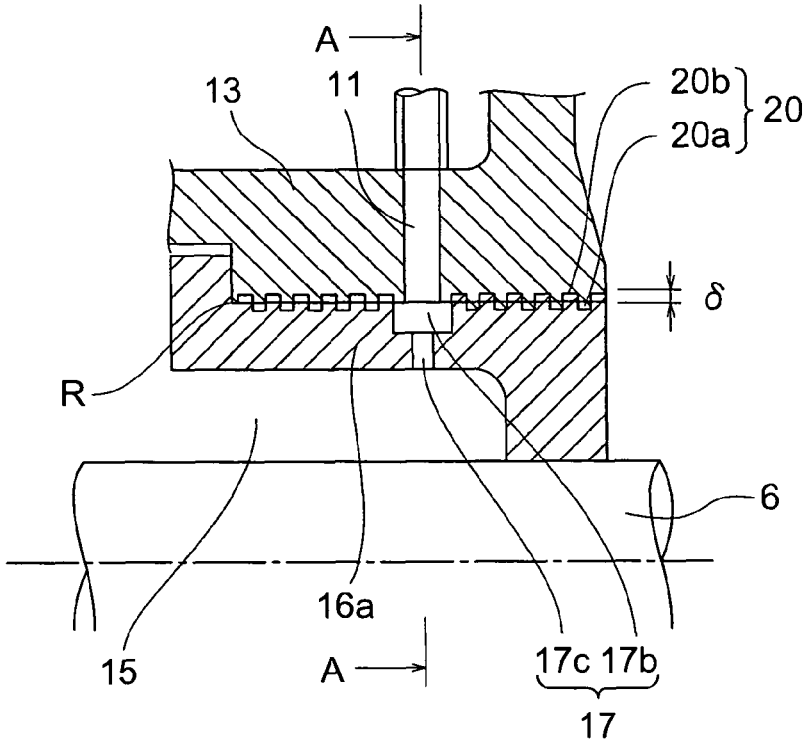
FIG. 5 is a vertical cross sectional view of the other embodiment of a shaft seal portion.
Figure 6:
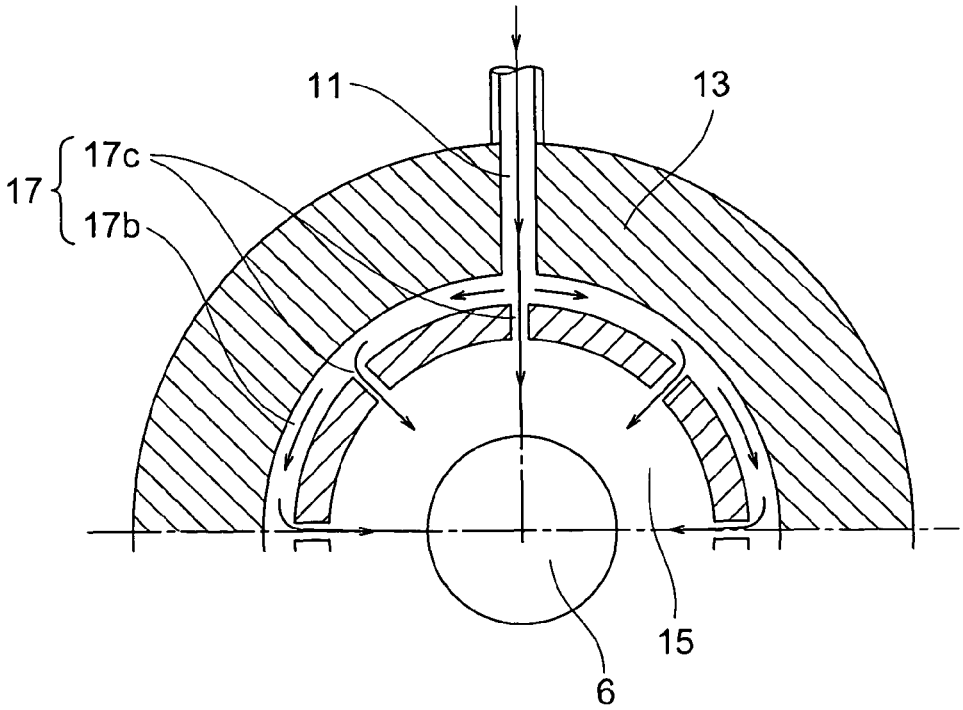
FIG. 6 is a horizontal cross sectional view of the other embodiment of the shaft seal portion.
Figure 7:
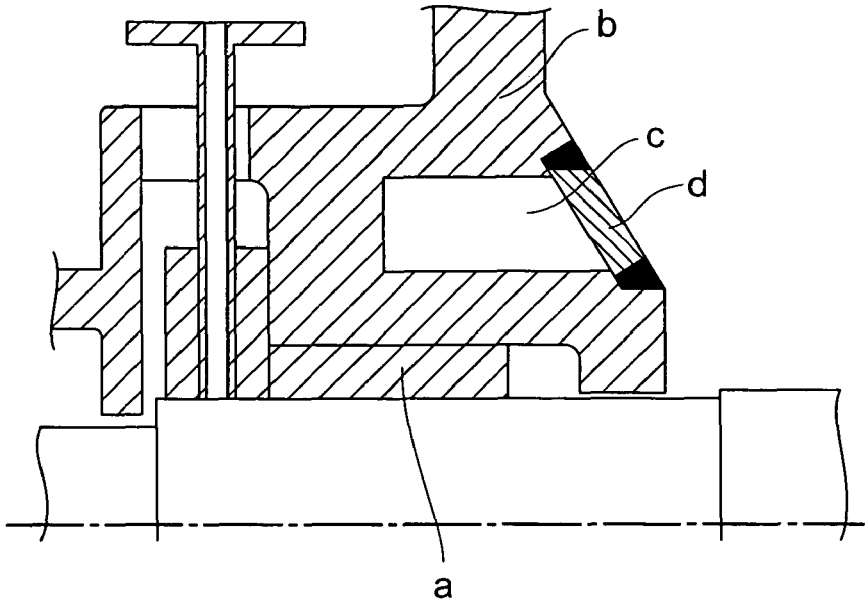
FIG. 7 PRIOR ART
FIG. 7 is a vertical cross sectional view of a portion near a shaft seal apparatus of a conventional industrial pump.
Figure 8:
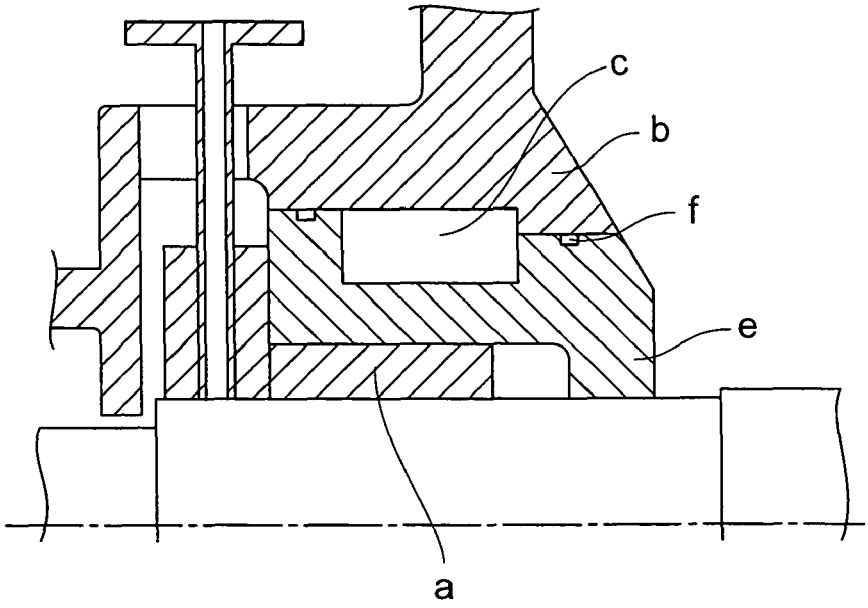
FIG. 8 PRIOR ART
FIG. 8 is a vertical cross sectional view of the portion near the shaft seal apparatus of the conventional industrial pump.

FIGS. 5 and 6 show the other embodiment of the shaft seal apparatus 16 in accordance with the present invention. In the cooling means 17 for cooling the shaft seal apparatus 16, an annular cooling water flow path 17*b* is formed in an outer peripheral surface of the shaft seal case 16*a*. An opening portion of the cooling water flow path 17*b* is sealed by the inner peripheral surface of the bracket 13. The water channel 11 for the cooling water is pierced in the outer peripheral portion of the bracket 13. The cooling water flows into the cooling water flow path 17*b* from the water filler 11. The cooling water fed to the cooling water flow path 17*b* flows into the shaft seal chamber 15 from a plurality of inflow ports 17*c* pierced in an inner peripheral side of the cooling water flow path 17*b* so as to cool the shaft seal apparatus 16. Thereafter, the cooling water is discharged to the external portion from an outflow port (not shown).

In the embodiment shown in FIG. 5, the outer peripheral surface of the shaft seal case 16*a* is shrink fitted to the inner peripheral surface of the bracket 13. The concave groove 20*a* and the protrusion 20*b* are alternately formed in the fitting surfaces 20 of the bracket 13 and the shaft seal case 16*a* in accordance with a machining process, in the same manner as shown in FIG. 2. A high surface pressure Pm can be obtained in the fitting surface 20 at a time of shrink fitting the shaft seal case 16*a*. The curvature R is formed in the corner portion in the fitting surface 20 side of the flange 16*b* protruded from one end side of the shaft seal case 16*a*. The curvature R prevents the stress from being concentrated in the root portion of the flange 16*b* after the shrink fitting.

In this case, in each of the embodiments, the bracket 13 and the shaft seal case 16*a* are manufactured in accordance with the forging, however, any one or both of them may be manufactured in accordance with a casting as far as the same material is employed. However, if both of the bracket 13 and the shaft seal case 16*a* are formed as the forged product, the defect generated at a time of casting runs out, and a repairing the defect is not necessary. Further, a quality of the parts is improved. In each of the embodiments mentioned above, the concave groove 20*a* and the protrusion 20*b* are formed in the outer peripheral surface of the shaft seal case 16*a*, however, the concave groove 20*a* and the protrusion 20*b* may be formed in the inner peripheral surface side of the bracket 13.

In accordance with the industrial pump of the present invention, since it is not necessary to weld the cover to the opening portion of the cooling means so as to close, the welding work and the heat treatment after the welding are not necessary. It is possible to reduce the working man hour required for the welding work and the heat treatment work, and it is possible to reduce the cost of the entire pump.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A manufacturing method of an industrial pump for rotatably supporting both end sides of a rotating shaft to which an impeller is attached by a bearing installed in a pump main body, and cooling a shaft seal apparatus arranged adjacent to said bearing by a cooling water introduced from an external portion, wherein the method comprises the steps of:

forming a cooling chamber or a cooling water flow path in any one of an inner peripheral surface of a bracket to which said shaft seal apparatus is provided, and an outer peripheral surface of said shaft seal case;

forming a concavo-convex surface having an annular concave groove and an annular protrusion having a sharp edge shape in a fitting surface of at least one of said bracket and said shaft seal case;

fitting said shaft seal case to the inner periphery of said bracket by heating said bracket; and thereafter integrating said bracket and said shaft seal case by cooling said bracket so that the annular protrusion bites into the fitting surface opposed thereto to plastically deform the fitting surface opposed thereto and fasten and integrate said bracket and said shaft seal case;

wherein side edges of said annular protrusion extend perpendicularly to said fitting surface.

2. A manufacturing method of an industrial pump as claimed in claim 1, wherein the bracket and the shaft seal case are fitted by cooling said shaft seal case at a time of heating said bracket.

3. A manufacturing method as claimed in claim 1, wherein, during said step of integrating said bracket and said shaft seal case, a fitting surface of any one of said bracket and said shaft seal case is plastically deformed and said annular protrusion bites into an opposing fitting surface.

4. A manufacturing method as claimed in claim 1, wherein a concavo-convex surface having an annular concave groove and an annular protrusion is provided in a fitting surface of each of said bracket and said shaft seal case.

5. A manufacturing method as claimed in claim 1, wherein a corner portion of the fitting portion of said bracket to said shaft seal case has a curvature R for avoiding a stress concentration at the corner portion after the shrink fitting.

* * * * *